US007112033B1

(12) United States Patent
Holdorf

(10) Patent No.: US 7,112,033 B1
(45) Date of Patent: Sep. 26, 2006

(54) HYGIENIC MECHANICAL SEAL FLUSHING SYSTEM FOR PURE LIQUIDS IN SANITARY CENTRIFUGAL PUMPS

(75) Inventor: Thomas M. Holdorf, Middleton, WI (US)

(73) Assignee: Wright Pumps, Inc., Waukesha, WI (US)

( * ) Notice: Subject to any disclaimer, the term of this patent is extended or adjusted under 35 U.S.C. 154(b) by 0 days.

(21) Appl. No.: 10/785,931

(22) Filed: Feb. 24, 2004

Related U.S. Application Data

(60) Provisional application No. 60/449,670, filed on Feb. 24, 2003.

(51) Int. Cl.
*F04D 29/12* (2006.01)
*F04D 29/58* (2006.01)
*F04D 29/70* (2006.01)

(52) U.S. Cl. ..... 415/1; 415/58.2; 415/58.4; 415/106; 415/112; 415/113; 415/168.2; 415/169.1; 415/180; 415/217.1; 277/360; 277/401; 277/408

(58) Field of Classification Search ..... 415/111–113, 415/180, 168.1, 168.2, 169.1, 58.2, 58.4, 415/106, 217.1; 277/360, 401, 408
See application file for complete search history.

(56) References Cited

U.S. PATENT DOCUMENTS

| | | | | |
|---|---|---|---|---|
| 2,240,782 | A * | 5/1941 | Jacobsen | 415/58.2 |
| 2,276,077 | A * | 3/1942 | Jacobsen | 415/58.2 |
| 2,427,656 | A * | 9/1947 | Blom | 415/111 |
| 2,741,991 | A * | 4/1956 | Disbrow | 415/58.2 |
| 2,777,395 | A * | 1/1957 | Disbrow | 415/112 |
| 2,905,093 | A * | 9/1959 | Raub et al. | 415/180 |
| 3,089,423 | A * | 5/1963 | Raub et al. | 415/180 |
| 3,128,713 | A * | 4/1964 | Nechine | 415/112 |
| 3,484,113 | A | 12/1969 | Moore | |
| 3,926,442 | A | 12/1975 | Muller | |
| 3,999,882 | A | 12/1976 | Purton | |
| 4,128,362 | A | 12/1978 | Shepherd et al. | |
| 4,130,287 | A | 12/1978 | Ritzie | |
| 4,613,141 | A | 9/1986 | Heinen | |
| 5,195,867 | A | 3/1993 | Stirling | |
| 5,372,730 | A | 12/1994 | Warner et al. | |
| 5,591,001 | A * | 1/1997 | Ray et al. | 415/111 |

(Continued)

FOREIGN PATENT DOCUMENTS

| | | | | |
|---|---|---|---|---|
| JP | 3-164599 | A * | 7/1991 | 415/111 |

(Continued)

OTHER PUBLICATIONS

Waukesha Cherry-Burrell, Pumps for the Bio/Pharm Industry, 2002, pp. 1-2, Delavan, Wisconsin, US.

(Continued)

*Primary Examiner*—Christopher Verdier
(74) *Attorney, Agent, or Firm*—Miller Matthias Hull

(57) ABSTRACT

A sanitary centrifugal pump with a hygienic mechanical seal flushing system. The pump has a housing with a pumping chamber defined therein. An impeller is at least partially contained in the housing and is connected to a shaft for rotation. The rotation of the impeller creates a first liquid flow path through the pumping chamber between the inlet port and the outlet port, and the first liquid flow path creates a high pressure area in the pumping chamber. The pump includes additional seal flushing passages by which liquid is delivered to the seal cavity from the pumping chamber and returned back to the pumping chamber, to cool and flush at least a portion of the mechanical seal in the seal cavity.

19 Claims, 3 Drawing Sheets

U.S. PATENT DOCUMENTS

| | | | | |
|---|---|---|---|---|
| 5,605,436 | A | 2/1997 | Pedersen | |
| 5,713,719 | A | 2/1998 | Fiore et al. | |
| 5,772,396 | A | 6/1998 | Rockwood | |
| 5,827,041 | A * | 10/1998 | Charhut | 415/112 |
| 6,099,243 | A | 8/2000 | Fiore | |
| 6,250,876 | B1 | 6/2001 | Hogholt | |

FOREIGN PATENT DOCUMENTS

| | | | | |
|---|---|---|---|---|
| SU | 715824 A * | 2/1980 | | 415/180 |

OTHER PUBLICATIONS

Waukesha Cherry-Burrell, WFI Mechanical Specifications, 1999, p. 1, Delavan, Wisconsin, US.

Waukesha Cherry-Burrell, Waukesha WFI Pump For Your Pharmaceutical Applications, p. 1, Delavan, Wisconsin, US.

Fristam Pumps, Inc., Sanitary Centrifugal Pumps, 1998, pp. 1-6, Middleton, Wisconsin, US.

Waukesha Cherry-Burrell, Centrifugal Pumps, 2000, pp. 1-16, Delavan, Wisconsin, US.

* cited by examiner

HYGIENIC MECHANICAL SEAL FLUSHING SYSTEM FOR PURE LIQUIDS IN SANITARY CENTRIFUGAL PUMPS

CROSS-REFERENCE TO RELATED APPLICATION

This application is based on and claims the benefit of U.S. Provisional Patent Application Ser. No. 60/449,670, filed on Feb. 24, 2003.

BACKGROUND OF THE INVENTION

The present invention relates generally to the field of sanitary centrifugal pumps, and more particularly to a hygienic mechanical seal flushing system for pure liquids in sanitary centrifugal pumps.

Sanitary centrifugal pumps are used for high purity liquids in the pharmaceutical, biotech, food, beverage and chemical industries. Of major concern in these industries are pump cleanliness and the need for continuous sterility. As a result, sanitary centrifugal pumps are typically made of stainless steel or other corrosion resistant materials, are machined instead of cast to eliminate pits, cracks, crevices and porosity, and are often polished to produce a very smooth finish. In addition, sanitary centrifugal pumps are typically part of a larger system of piping, valves, filters and other processing equipment. This equipment requires the ability to be cleaned-in-place or steamed-in-place without substantial disassembly. In addition, the liquid being pumped must be used to cool and flush the mechanical seals, instead of a flushing liquid from an outside source, to ensure that the flushing liquid does not contaminate the liquid being pumped.

Typical prior art flushing systems for sanitary centrifugal pumps use a series of external pipes or tubing, valves, gaskets and connections that are tapped from the outlet port of the pump and routed into the seal cavity to provide a circulation loop of liquid to lubricate and cool the front seal face of the mechanical seal. An additional external recirculation loop can be tapped from the outlet port, the circulation loop, or other areas in the pump housing and routed into an area adjacent the stationary section of the mechanical seal to cool and flush the front and rear seal faces in double mechanical seal applications.

Prior art sanitary pumps with external flushing systems present a number of problems relating to the sterility of the pumps. External piping with bends, elbows, connectors, gaskets, valves, unions, gauges, and flow meters all present possible areas of contamination and are less able to be cleaned-in-place or steamed-in-place effectively. The external piping is also susceptible to damage and subject to vibration and leakage. Further, the external piping must be disassembled for adequate inspection, the bends and elbows must be inspected with borescopes, and reassembly allows for potential errors, contamination, misalignment, and gasket deformation. Great care, in addition, must be taken to install all piping with no horizontal runs or low points, as product may collect in "dead leg" areas not sloped correctly to allow full draining.

The present invention relates to improvements over the sanitary centrifugal pumps and seal flushing systems described above, and to solutions to the problems raised or not solved thereby.

SUMMARY OF THE INVENTION

The present invention provides a sanitary centrifugal pump with a hygienic mechanical seal flushing system. The pump has a housing with a front side, a back side, an inlet port, an outlet port, and defining a pumping chamber. An impeller is at least partially contained in the housing and is connected to a shaft for rotation. The rotation of the impeller creates a first liquid flow path through the pumping chamber between the inlet port and the outlet port, and creates a high pressure area in the pumping chamber. A back plate is fastened to the back side of the housing and defines a seal cavity and a gap. The gap is preferably located between the impeller and a front wall of the back plate. A mechanical seal is positioned at least partially within the seal cavity and mounted in combination with the shaft and the back plate. At least a first seal flushing passage is integrally provided in the back plate, creating a second liquid flow path between the pumping chamber and the seal cavity for cooling and flushing at least a portion of the mechanical seal in the seal cavity. The first seal flushing passage delivers liquid to the seal cavity from the pumping chamber and the gap permits the flow of liquid back to the pumping chamber from the seal cavity.

The first seal flushing passage ideally extends from the high pressure area of the pumping chamber to the seal cavity and is preferably a substantially straight-line passage machined into the back plate in a sloped orientation. The impeller also preferably includes a central hub area having at least one opening therein for delivering liquid back into the pumping chamber from the seal cavity. In addition, the present invention ideally includes a pumping chamber drain located adjacent a substantially lowest point of the pumping chamber and ideally controlled with a drain valve assembly to allow liquid to exit the pumping chamber.

The present invention can also include a second seal flushing passage, a third seal flushing passage, and a seal flushing drain passage. The second seal flushing passage ideally extends from the seal cavity to a pocket defined in the back plate, the third seal flushing passage ideally extends from the pocket to a flushing zone adjacent a stationary section of the mechanical seal, and the seal flushing drain passage ideally extends from the flushing zone to a drainage area outside the sanitary centrifugal pump. The second and third seal flushing passages preferably create a third liquid flow path between the seal cavity, the flushing zone, and the drainage area for cooling and flushing a second portion of the mechanical seal adjacent the flushing zone. The second seal flushing passage ideally delivers liquid from the seal cavity to the pocket, the third seal flushing passage ideally delivers liquid from the pocket to the flushing zone, and the seal flushing drain ideally delivers liquid from the flushing zone to the drainage area. A sanitary control valve assembly can also be used to regulate the third liquid flow path. Preferably, the second and third seal flushing passages and the seal flushing drain passage are substantially straight-line passages machined into the back plate in a sloped or vertical orientation.

In addition, the mechanical seal of the present invention can be a single or double mechanical seal. Further, the housing, back plate, impeller and shaft are ideally formed from corrosion resistant materials, and the back plate is ideally formed by a machining process.

The present invention also provides a hygienic mechanical seal flushing system for a sanitary centrifugal pump. The flushing system includes a first seal flushing passage integrally provided in a back plate of the pump extending from a pumping chamber in the pump to a seal cavity defined by the back plate, a gap defined by an impeller in the pump and a front wall of the back plate, and at least an opening in a central hub area of the impeller. The system further includes a second seal flushing passage integrally provided in the back plate extending from the seal cavity to a pocket defined in the back plate, a third seal flushing passage integrally defined in the back plate extending from the pocket to a flushing zone adjacent a stationary section of the mechanical seal, and a seal flushing drain passage integrally provided in the back plate extending from the flushing zone to a drainage area outside the pump.

The first seal flushing passage delivers liquid from the pumping chamber to the seal cavity, and the gap and the at least one opening in the impeller deliver liquid from the seal cavity to the pumping chamber, thereby cooling and flushing at least a portion of the mechanical seal in the seal cavity. The second seal flushing passage delivers liquid from the seal cavity to the pocket, the third seal flushing passage delivers liquid from the pocket to the flushing zone, the seal flushing drain delivers liquid from the flushing zone to the drainage area outside the pump, thereby cooling and flushing a second portion of the mechanical seal.

The first, second, and third seal flushing passages and the seal flushing drain passage are ideally substantially straight-line passages machined into the back plate. In addition, the flushing system preferably includes a pumping chamber drain located adjacent a substantially lowest point of the pumping chamber to allow liquid to exit the pumping chamber. The pumping chamber drain is ideally controlled with a drain valve assembly. The flushing system also preferably includes a sanitary control valve assembly to regulate the liquid delivered to the flushing zone.

The present invention also contemplates a method for flushing a mechanical seal for a sanitary centrifugal pump. The method includes the steps of delivering liquid from a high pressure area of a pumping chamber of the pump to a seal cavity of the pump through a first seal flushing passage integrally defined in a back plate of the pump, flushing and cooling at least a portion of the mechanical seal in the seal cavity with the liquid, and delivering the liquid back to the pumping chamber from the seal cavity through a gap between an impeller in the pump and a wall of the back plate. Liquid can also be delivered back to the pumping chamber from the seal cavity through an opening in the impeller. The method can also include the steps of setting a sanitary control valve assembly adjacent a pocket defined in the back plate to a desired liquid flow and pressure level, delivering liquid from the seal cavity to the pocket through a second seal flushing passage, delivering liquid from the pocket to a flushing zone near a stationary section of the mechanical seal through a third seal flushing passage, flushing and cooling a second portion of the mechanical seal adjacent the flushing zone with the liquid, and delivering the liquid from the flushing zone to a drainage area outside the pump through a seal flushing drain passage.

The present invention has many advantages over the prior art. The internal flushing system, for example, eliminates the problems associated with the prior art external circulation and recirculation loop flushing systems, including their susceptibility to damage and leakage, and allows the pump to be steamed-in-place and cleaned-in-place more effectively. In addition, the internal flushing system reduces the length of travel or path of the seal flushing liquid, allowing the mechanical seal and the seal cavity to be cooled and flushed with less pressure drop in the liquid.

Further, the use of substantially straight-line passages allows each passage to be inspected quickly if necessary with the naked eye, thus eliminating the need for special optical inspection devices such as borescopes. Use of substantially straight-line passages also greatly improves the ability to clean and sterilize all areas of the pump effectively. The straight-line passages can also be polished to the necessary surface finishes to maintain sterility. In addition, the passages can be many different sizes and in many different locations to facilitate various product viscosities, temperatures, flow rates, pressures or other unique product features.

Another advantage of the present invention is the vertical or sloped orientation of each passage, which allows the passages to fully drain to the lowest point in the pumping chamber when the pump is not in operation. The collected liquid may then be discharged through a pumping chamber drain by use of a drain valve assembly. Thus, all "dead legs" are eliminated and sterility is maintained.

In addition, the back plate of the pump of the present invention is much thicker than is normally necessary for simple pumping applications to accommodate the internal passages. The thicker back plate thus can be used to make additional passages and ports for monitoring of pressure, flow, temperature or other details relating to pump performance by simply attaching such devices to the back plate.

Various other features, objects, and advantages of the present invention will be made apparent to those skilled in the art from the following detailed description and accompanying drawings.

DETAILED DESCRIPTION OF THE INVENTION

Figure 1:
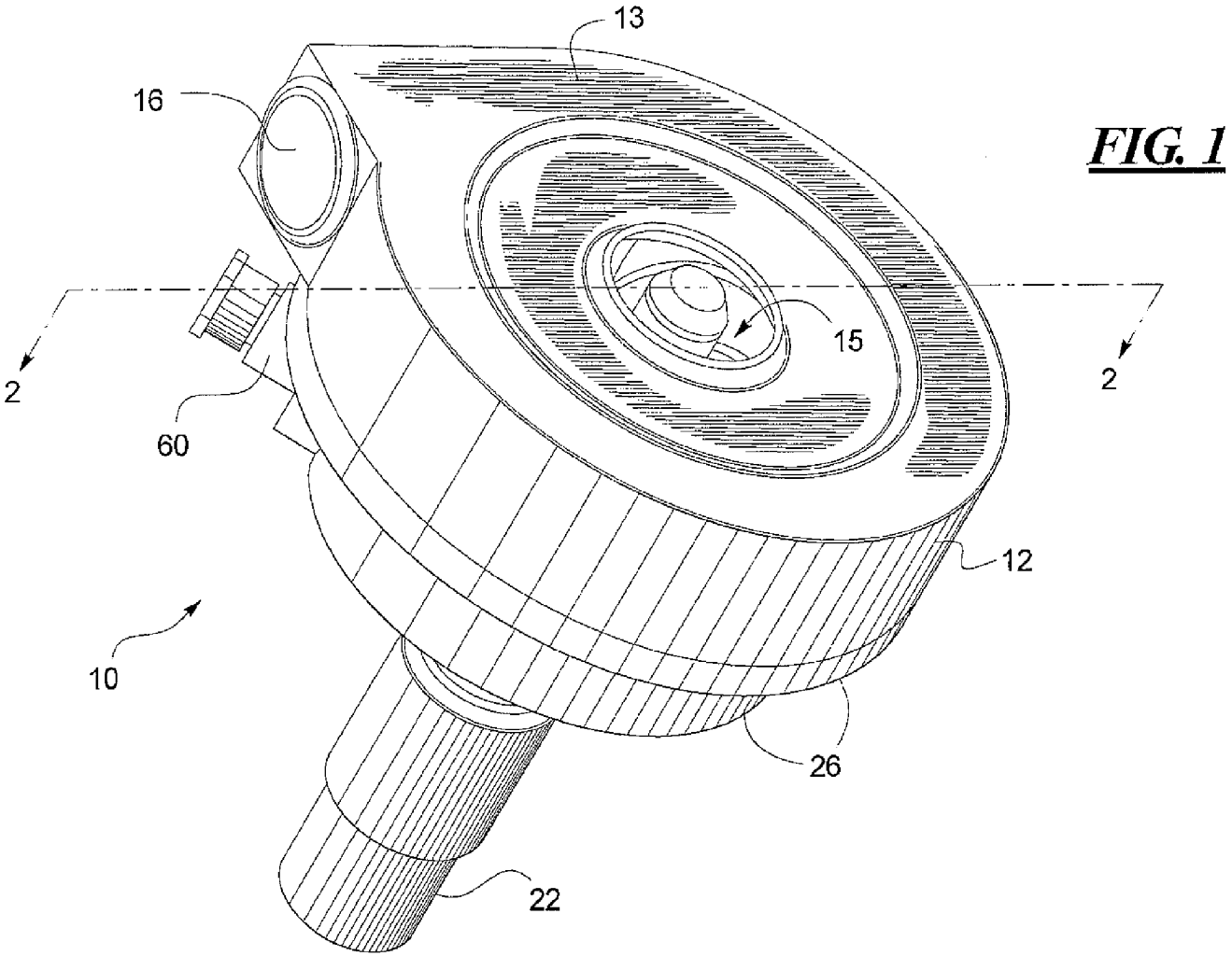
FIG. 1 is a perspective view of the sanitary centrifugal pump constructed according to a preferred embodiment of the invention.

Referring now to FIG. 1, a sanitary centrifugal pump 10 constructed according to a preferred embodiment of the invention has several main components. The pump 10 includes a housing 12 having a front side 13, an inlet port 15 formed in the face of the front side 13, and an outlet port 16 formed in the side of the housing 12.

Figure 2:
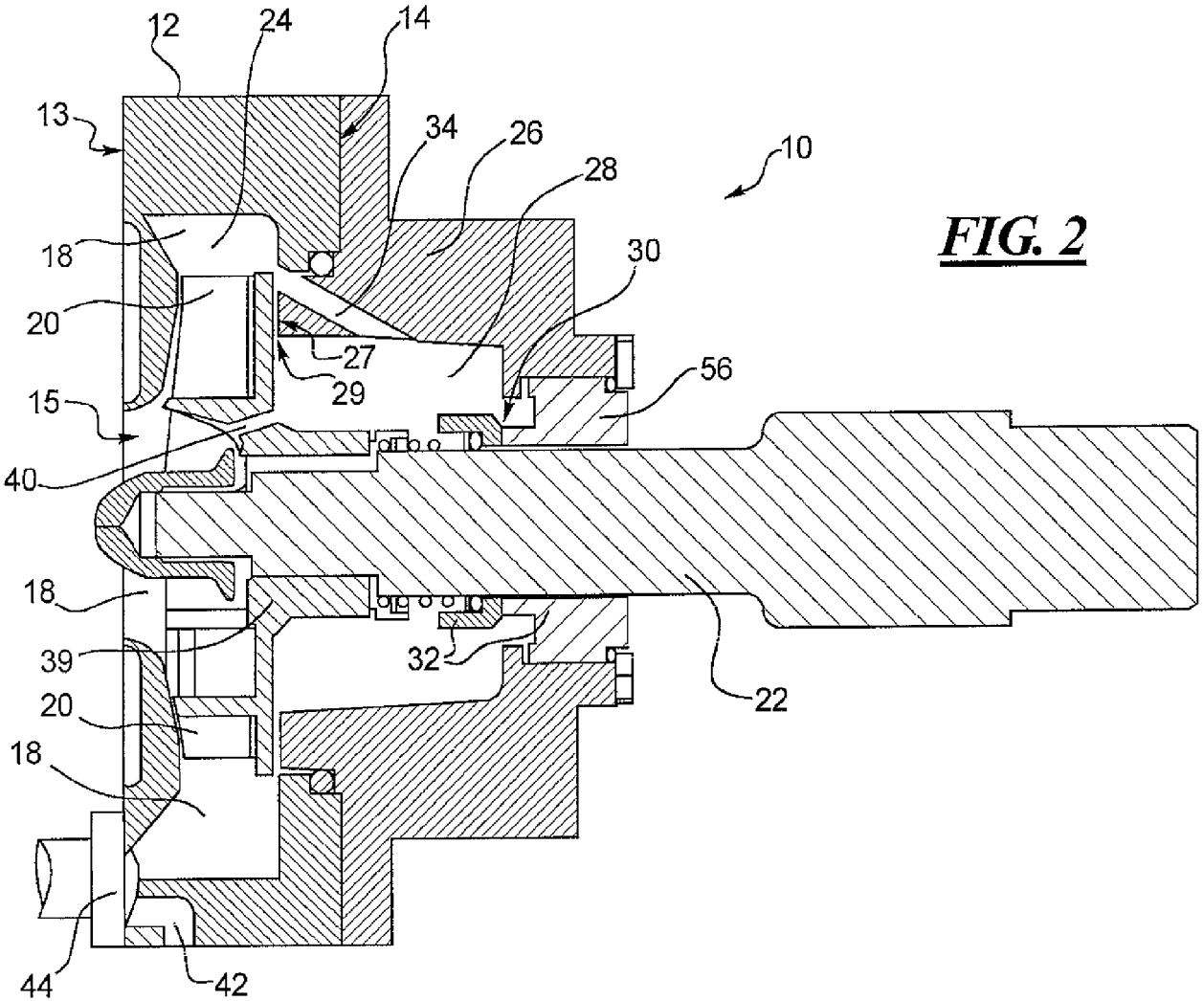
FIG. 2 is a cross-sectional view of the sanitary centrifugal pump shown in FIG. 1 taken along line 2—2.

Referring to FIG. 2, the housing 12 further defines a pumping chamber 18 therein. An impeller 20, positioned within the housing 12, is connected to a shaft 22 that is mechanically coupled to a motor (not shown) and is journaled for rotation within the housing 12. A back plate 26 is fastened to a back side 14 of the housing 12 to seal the back side 14 of the housing 12. The back plate 26 defines an annular seal cavity 28 behind the impeller 20 and, with the impeller 20, defines a gap 29 between the impeller and a front wall 27 of the back plate 26. A mechanical seal 32 is at least partially positioned in the seal cavity 28 and is mounted in combination with the shaft 22 and the back plate 26. The rotation of the shaft 22 causes rotation of the impeller 20, which creates a first liquid flow path through the pumping chamber 18 between the inlet port 15 and the outlet port 16. The centrifugal force created by the rotation of the impeller 20 forces the liquid entering the inlet port 15 out to the circumference of the pumping chamber 18, which becomes a high pressure area 24 of the pumping chamber 18. The seal cavity 28 is generally a low pressure area, wherein entrapped liquid can create excessive heat and debris collection.

FIG. 2 shows a preferred embodiment of the present invention wherein the pump 10 has a single mechanical seal 32 with a front seal face 30. In the embodiment shown in FIG. 2, a first seal flushing passage 34 is integrally provided in the back plate 26 to permit fluid communication between the high pressure area 24 and the seal cavity 28, thus creating a second liquid flow path between the pumping chamber 18 and the seal cavity 28 for cooling and flushing the seal cavity 28, the front seal face 30, and a portion of the mechanical seal 32 within the seal cavity. The first seal flushing passage 34 permits the flow of liquid to the seal cavity 28 from the pumping chamber 18, and the gap 29 permits the flow of liquid back to the pumping chamber 18 from the seal cavity 28, thereby balancing the internal pressure of the pump. Liquid also preferably returns to the pumping chamber 18 through an opening 40 in the hub area 39 of the impeller 20, to the area of the inlet port 15. The first seal flushing passage 34 is ideally a sloped, substantially straight-line passage as shown to allow liquid to collect at substantially the lowest point in the pumping chamber 18 when the pump 10 is not in operation. The collected liquid can preferably be drained from the pumping chamber 18 through a pumping chamber drain 42 preferably located adjacent the substantially lowest point in the pumping chamber 18. The pumping chamber drain 42 is ideally controlled by a drain valve assembly 44. The drain valve assembly 44 is preferably a diaphragm valve, wherein the valve body is machined into the housing 12 and the valve actuator is attached to the outside of the housing 12. The use of a drain valve assembly 44 as shown eliminates the small section of drain pipe that is typically used in prior art sanitary centrifugal pumps. The small drain pipe of the prior art allows liquid to collect and stagnate therein, creating a "dead leg" area. The drain valve assembly 44 is flush with the pumping chamber 18 and is thus constantly swept with liquid during pump operation so no "dead leg" area is created. The drain valve assembly 44 is ideally always closed during pump operation and opened only when draining is required.

Figure 3:
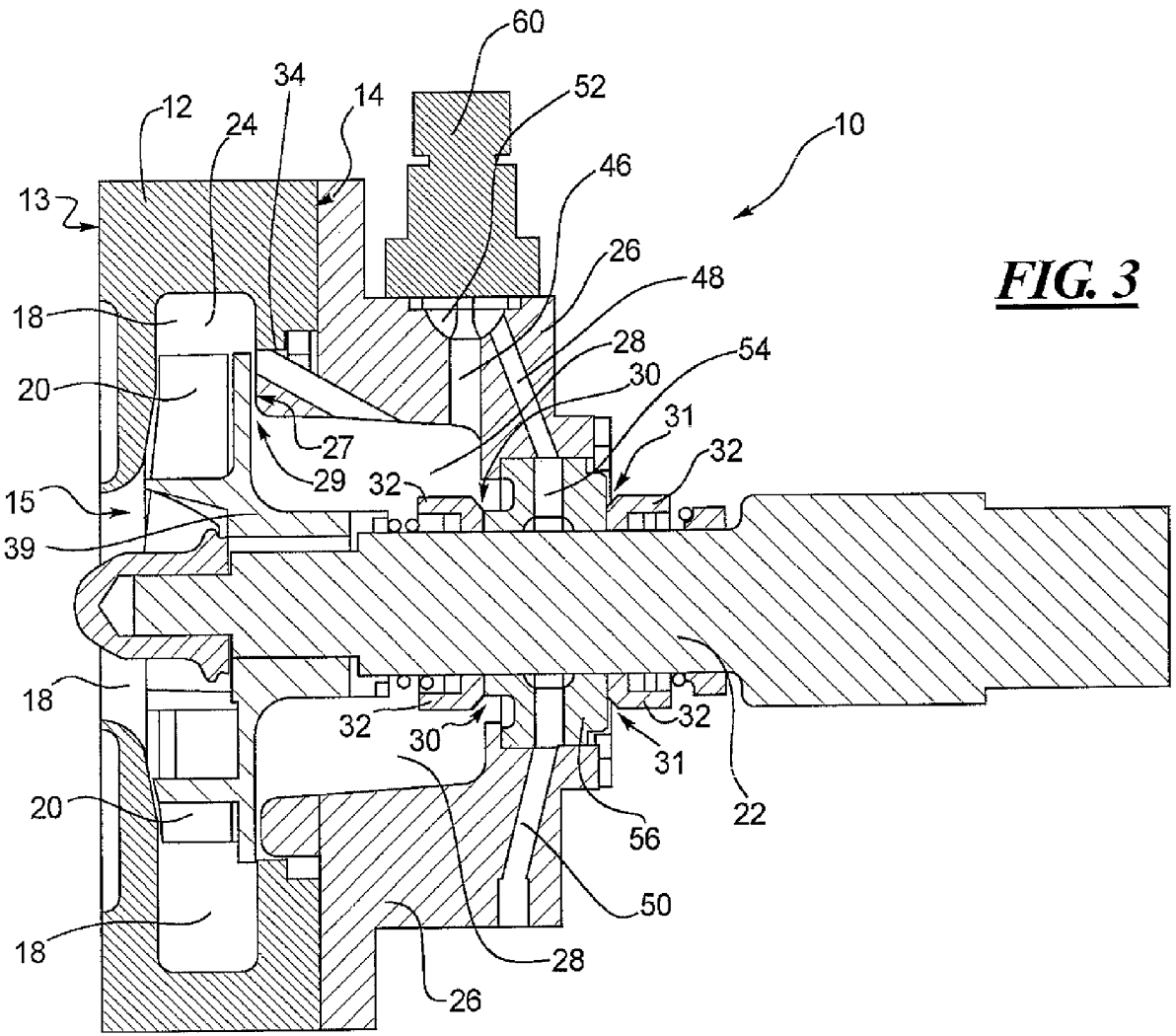
FIG. 3 is a cross-sectional view of a sanitary centrifugal pump as shown in FIG. 1, taken along line 2—2, but in internal detail constructed according to another embodiment of the invention.

FIG. 3 shows another preferred embodiment of the present invention providing a pump 10A that has a double mechanical seal 32 with a front seal face 30 and a rear seal face 31. As in the embodiment shown in FIG. 2, liquid from the high pressure area 24 of the pumping chamber 18 enters the seal cavity 28 through the first seal flushing passage 34 to cool and flush the seal cavity 28 and the front seal face 30, and liquid returns to the pumping chamber 18 through gap 29. Although not shown in FIG. 3, liquid can ideally also return to the pumping chamber 18 through an opening 40 in the impeller 20 as shown in FIG. 2. In this embodiment, liquid in the seal cavity 28 also ideally enters a second seal flushing passage 46, which preferably delivers the liquid to a pocket 52 defined in the back plate 26. From the pocket 52, liquid ideally enters a third seal flushing passage 48, which preferably delivers the liquid to a flushing zone 54 adjacent a stationary section 56 of the mechanical seal 32, where the liquid cools and flushes the front seal face 30 and rear seal face 31. From the flushing zone 54, liquid ideally enters a seal flushing drain passage 50, which preferably delivers the liquid to a drainage area outside the pump 10A. The second and third seal flushing passages 46, 48 thereby create a third liquid flow path connecting the seal cavity 28, the flushing zone 54, and the drainage passage 50 for cooling and flushing a portion of the mechanical seal 32 adjacent the flushing zone 54.

In all of the embodiments where they are used, the first, second and third seal flushing passages 34, 46, 48 and the seal flushing drain passage 50 are ideally sloped or vertical substantially straight-line passages as shown in FIGS. 2 and 3. Straight-line passages are easy to inspect during the pump cleaning process, and also allow liquid to collect in substantially the lowest point of the pumping chamber 18 when the pump 10 is not in operation. The seal flushing passages 34, 46, 48 and the seal flushing drain passage 50 can be varied in size depending upon the size of the pump, the viscosity of the liquid being pumped, the desired flow and pressure for flushing the mechanical seal 32 or the convenience desired for visually inspecting the passages 34, 46, 48 and 50. The preferred size range for these passages in sanitary centrifugal pump applications is 0.25 (¼)–0.375 (⅜) inches in diameter, because that range allows the passages to be large enough to be polished as is typically required in sanitary applications, and small enough to maintain sufficient pump efficiency. Other passage sizes, however, may also be suitable for certain applications of the present invention. Additional passages could also be added anywhere from the high pressure area 24 of the pumping chamber 18 to the seal cavity 28 to create more flushing and cooling of the mechanical seal 32. In addition, a pumping chamber drain 42 preferably controlled by a drain valve assembly 44 as shown in FIG. 2 could also be used in connection with the preferred embodiment of FIG. 3.

The preferred embodiment of FIG. 3 also shows a sanitary control valve assembly 60 located adjacent the pocket 52. The sanitary control valve assembly 60 is ideally used to regulate the flow and pressure of the liquid that cools and flushes the front and rear seal faces 30, 31; however, the pocket 52 can also be sealed or unregulated to allow the full flow and pressure of the liquid to be used to cool and flush the front and rear seal faces 30, 31. Sanitary control valve assembly 60 can be a manual or automatic valve or a combination of valves, and the pocket 52 can be customized to accommodate any type or size sanitary control valve assembly 60 suitable to obtain the desired pressure or flow. Ideally, the sanitary control valve assembly includes a diaphragm valve (not shown) machined in to the back plate 26 in or adjacent the pocket 52, allowing liquid to travel to a needle valve (not shown) for fine adjustment of 1–2 gallons per hour and 5–7 pounds per square inch. The sanitary control valve assembly 60 is ideally always open when the pump 10 is in operation, and closed when the pump 10 is not in operation.

All of the components that come into contact with liquid, such as the housing 12, the impeller 20, and the back plate 26, are ideally machined from solid or forged 316L stainless steel. The machining process eliminates the pits, cracks, crevices and high levels of ferrite associated with a traditional casting process, and the stainless steel resists corrosion. A casting process could, however, be used to manufacture the components of the present invention, and other corrosion resistant materials, preferably those with high nickel content, could also be used. Further, the interior surfaces, such as the pumping chamber 18 and passages 34, 46, 48 and 50, are ideally polished for the highest purity applications.

While the invention has been described with reference to preferred embodiments, it is to be understood that the invention is not intended to be limited to the specific embodiments set forth above. It is recognized that those skilled in the art will appreciate certain substitutions, alterations, modifications, and omissions may be made without parting from the spirit or intent of the invention. Accordingly, the foregoing description is meant to be exemplary only, the invention is to be taken as including all reasonable equivalents to the subject matter of the invention, and should not limit the scope of the invention.

What is claimed is:

1. A sanitary centrifugal pump comprising:

a housing having a front side, a back side, an inlet port, an outlet port, and defining a pumping chamber;

an impeller positioned at least partially within the housing and connected to a shaft for rotation, the rotation of the impeller creating a first liquid flow path through the pumping chamber between the inlet port and the outlet port, and creating a high pressure area in the pumping chamber;

a back plate fastened to the back side of the housing, the back plate defining a seal cavity, and a gap between the impeller and a front wall of the back plate;

a mechanical seal positioned at least partially within the seal cavity and mounted in combination with the shaft and the back plate;

a first seal flushing passage integrally disposed within and passing through the back plate creating a second liquid flow path between the pumping chamber and the seal cavity for cooling and flushing at least a portion of the mechanical seat disposed within the seal cavity, the first seal flushing passage delivering liquid to the seal cavity from the pumping chamber and the gap permitting flow of liquid back to the pumping chamber from the seal cavity; and second and third seal flushing passages disposed within and passing through the back plate and creating a third liquid flow path between the seal cavity and a flushing zone adjacent a stationary section of the mechanical seal, and a seal flushing drain passage extending from the flushing zone to a drainage area outside the sanitary centrifugal pump.

2. The sanitary centrifugal pump of claim 1, wherein the first seal flushing passage extends from the high pressure area of the pumping chamber to the seal cavity.

3. The sanitary centrifugal pump of claim 1, wherein the impeller includes a central hub area having at least an opening therein for delivering liquid back to the pumping chamber from the seal cavity.

4. The sanitary centrifugal pump of claim 1, wherein the first seal flushing passage is a substantially straight-line passage machined into the back plate in a sloped orientation.

5. The sanitary centrifugal pump of claim 1, further comprising a pumping chamber drain located adjacent a substantially lowest point of the pumping chamber, the pumping chamber drain allowing liquid to exit the pumping chamber.

6. The sanitary centrifugal pump of claim 5, wherein the pumping chamber drain interacts with a drain valve assembly to control the liquid allowed to exit the pumping chamber.

7. The sanitary centrifugal pump of claim 1, wherein the mechanical seal is a double mechanical seal.

8. The sanitary centrifugal pump of claim 1, wherein the housing, back plate, impeller and shaft are formed from corrosion resistant materials.

9. The sanitary centrifugal pump of claim 1, wherein the back plate is manufactured by a machining process.

10. A sanitary centrifugal pump comprising:

a housing having a front side, a back side, an inlet port, an outlet port, and defining a pumping chamber;

an impeller positioned at least partially within the housing and connected to a shaft for rotation, the rotation of the impeller creating a first liquid flow path through the pumping chamber between the inlet port and the outlet port, and creating a high pressure area in the pumping chamber;

a back plate fastened to the back side of the housing, the back plate defining a seal cavity, and a gap between the impeller and a front wall of the back plate;

a mechanical seal positioned at least partially within the seal cavity and mounted in combination with the shaft and the back plate;

at least a first seal flushing passage integrally provided in the back plate creating a second liquid flow path, between the pumping chamber and the seal cavity, for cooling and flushing at least a portion of the mechanical seal in the seal cavity, the first seal flushing passage delivering liquid to the seal cavity from the pumping chamber and the gap permitting flow of liquid back to the pumping chamber from the seal cavity; and a second seal flushing passage, a third seal flushing passage, and a seal flushing drain passage, wherein the second seal flushing passage extends from the seal cavity to a pocket defined in the back plate, the third seal flushing passage extends from the pocket to a flushing zone adjacent a stationary section of the mechanical seal, and the seal flushing drain passage extends from the flushing zone to a drainage area outside the sanitary centrifugal pump.

11. The sanitary centrifugal pump of claim 10, wherein the second and third seal flushing passages create a third liquid flow path between the seal cavity, the flushing zone, and the drainage area for cooling and flushing a second portion of the mechanical seal adjacent the flushing zone, wherein the second seal passage delivers liquid from the seal cavity to the pocket, the third seal flushing passage delivers liquid from the pocket to the flushing zone, and the seal flushing drain passage delivers liquid from the flushing zone to the drainage area.

12. The sanitary centrifugal pump of claim 11, wherein a sanitary control valve assembly located adjacent the pocket regulates the third liquid flow path.

13. The sanitary centrifugal pump of claim 10, wherein the second and third seal flushing passages, and the seal flushing drain passage are substantially straight-line passages machined into the back plate in a sloped or vertical orientation.

14. A hygienic mechanical seal flushing system for a sanitary centrifugal pump, the flushing system comprising:

a first seal flushing passage integrally provided in a back plate of the pump extending from a high pressure area of a pumping chamber in the pump to a seal cavity defined by the back plate;

a gap defined by an impeller in the pump and a front wall of the back plate;

at least an opening in a central hub area of the impeller;

a second seal flushing passage integrally provided in the back plate extending from the seal cavity to a pocket defined in the back plate;

a third seal flushing passage integrally provided in the back plate extending from the pocket to a flushing zone adjacent a stationary section of the mechanical seal;

a seal flushing drain passage integrally provided in the back plate extending from the flushing zone to a drainage area outside the pump;

wherein, the first seal flushing passage delivers liquid from the pumping chamber to the seal cavity, and the gap and the at least one opening in the impeller deliver liquid from the seal cavity to the pumping chamber, thereby cooling and flushing at least a portion of the mechanical seal in the seal cavity; and wherein, the second seal flushing passage delivers liquid from the seal cavity to the pocket, the third seal flushing passage delivers liquid from the pocket to the flushing zone, the seal flushing drain delivers liquid from the flushing zone to the area outside the pump, thereby cooling and flushing a second portion of the mechanical seal.

15. The flushing system of claim 14, wherein the first, second and third seal flushing passages and the seal flushing drain passage are substantially straight-line passages machined into the back plate.

16. The flushing system of claim 14, further comprising a pumping chamber drain located adjacent a substantially lowest point of the pumping chamber, the pumping chamber drain interacting with a drain valve assembly to allow liquid to exit the pumping chamber.

17. The flushing system of claim 14, further comprising a sanitary control valve assembly to regulate the liquid delivered to the flushing zone.

18. A method for flushing a mechanical seal for a sanitary centrifugal pump, comprising the steps of:

delivering liquid from a high pressure area of a pumping chamber of the pump through a first seal flushing passage that passes through a back plate to a seal cavity of the pump;

flushing and cooling at least a portion of the mechanical seal disposed within the seal cavity with the liquid passing through the first seal flushing passage;

delivering liquid from the seal cavity through second and third connected seal flushing passages that pass through the back plate to a flushing zone adjacent a stationary portion of the mechanical seal that is not disposed within the seal cavity;

flushing and cooling the stationary portion of the mechanical seal not disposed within the seal cavity with the liquid passing through the second and third connected seal passageways;

delivering liquid back to the pumping chamber from the seal cavity through a gap between an impeller in the pump and a wall of the back plate;

delivering liquid from the flushing zone to a drainage area outside the pump through a seal flushing drain passage.

19. A method for flushing a mechanical seal for a sanitary centrifugal pump, comprising:

delivering liquid from a high pressure area of a pumping chamber of the pump to a seal cavity of the pump through a first seal flushing passage integrally defined in a back plate of the pump;

flushing and cooling at least a portion of the mechanical seal in the seal cavity with the liquid;

delivering the liquid back to the pumping chamber from the seal cavity through a gap between an impeller in the pump and a wall of the back plate wherein the liquid is delivered back to the pumping chamber from the seal cavity, besides through the gap, through an opening in the impeller;

setting a sanitary control valve assembly adjacent a pocket defined in the back plate to a desired liquid flow and pressure level;

delivering liquid from the seal cavity to the pocket through a second seal flushing passage;

delivering liquid from the pocket to a flushing zone near a stationary section of the mechanical seal through a third seal flushing passage;

flushing and cooling a second portion of the mechanical seal adjacent the flushing zone with the liquid; and delivering the liquid from the flushing zone to a drainage area outside the pump through a seal flushing drain passage.

* * * * *

UNITED STATES PATENT AND TRADEMARK OFFICE

CERTIFICATE OF CORRECTION

PATENT NO. : 7,112,033 B1
APPLICATION NO. : 10/785931
DATED : September 26, 2006
INVENTOR(S) : Thomas M. Holdorf It is certified that error appears in the above-identified patent and that said Letters Patent is hereby corrected as shown below:

On the Title Page:

Item (73) Assignee: Reads "Wright Pumps, Inc.," which is incorrect The correct way it should read is (73) Assignee: --Wright Pump.--

Signed and Sealed this

Sixth Day of February, 2007

JON W. DUDAS
*Director of the United States Patent and Trademark Office*